US008794711B2

(12) United States Patent
Paton-Ash

(10) Patent No.: US 8,794,711 B2
(45) Date of Patent: Aug. 5, 2014

(54) REFUGE CHAMBER AND METHOD

(75) Inventor: Gregory Paton-Ash, Marietta, GA (US)

(73) Assignee: Strata Products Worldwide, LLC, Sandy Springs, GA (US)

( * ) Notice: Subject to any disclaimer, the term of this patent is extended or adjusted under 35 U.S.C. 154(b) by 0 days.

(21) Appl. No.: 13/460,252

(22) Filed: Apr. 30, 2012

(65) Prior Publication Data

US 2013/0049436 A1 Feb. 28, 2013

Related U.S. Application Data

(63) Continuation of application No. 11/903,079, filed on Sep. 20, 2007, now abandoned.

(60) Provisional application No. 60/846,432, filed on Sep. 22, 2006.

(51) Int. Cl.
*E21F 11/00* (2006.01)

(52) U.S. Cl.
USPC ..... 299/12

(58) Field of Classification Search
USPC ..... 299/12; 135/88.13, 96, 97, 904; 52/2.12, 2.13, 2.17, 2.18, 2.23, 79.5
See application file for complete search history.

(56) References Cited

U.S. PATENT DOCUMENTS

| | | | | |
|---|---|---|---|---|
| 3,261,659 | A | 7/1966 | Schwichtenberg et al. | |
| 3,393,479 | A | 7/1968 | Slotnick | |
| 4,096,702 | A | 6/1978 | Burton | |
| 4,815,363 | A | 3/1989 | Harvey | |
| 5,331,991 | A | 7/1994 | Nilsson | |
| 5,398,676 | A | 3/1995 | Press et al. | |
| 5,411,046 | A | 5/1995 | Wan | |
| 5,537,784 | A * | 7/1996 | Baldwin | 52/2.17 |
| 5,630,296 | A | 5/1997 | Kendall | |
| 5,706,846 | A * | 1/1998 | Sutton | 135/128 |
| 5,727,353 | A | 3/1998 | Getz et al. | |
| 5,862,819 | A | 1/1999 | Cradeur | |
| 6,192,633 | B1 | 2/2001 | Hilbert | |
| 6,708,451 | B1 | 3/2004 | Gomes | |
| 7,198,045 | B2 | 4/2007 | Risley et al. | |
| 7,695,049 | B2 * | 4/2010 | Colborne | 296/161 |
| 2002/0083653 | A1 | 7/2002 | Hilbert | |

(Continued)

FOREIGN PATENT DOCUMENTS

| | | | |
|---|---|---|---|
| CN | 2186299 | Y | 12/1994 |
| CN | 1814969 | A | 8/2006 |

(Continued)

OTHER PUBLICATIONS

"Trapped Miners Now Have Chance for Survival!" article, Ed Rosciolli, Apr. 18, 2006.*

*Primary Examiner* — Sunil Singh
(74) *Attorney, Agent, or Firm* — Ansel M. Schwartz

(57) ABSTRACT

A refuge chamber for miners in a mine includes a skid. The chamber includes a tent that is disposed in the skid in an undeployed state which is expandable to a deployed state and extends from the skid to provide a protected atmosphere for the miners. A method for providing a refuge chamber for miners in a mine including the steps of opening a skid made of metal. There is the step of expanding a tent that is disposed in the skid in an undeployed state to a deployed state that extends from the skid to provide a protected atmosphere for the miners.

17 Claims, 18 Drawing Sheets

(56) References Cited

U.S. PATENT DOCUMENTS

| | | | | |
|---|---|---|---|---|
| 2006/0055193 | A1 | 3/2006 | Colborne | |
| 2007/0199244 | A1 | 8/2007 | Kennedy | |
| 2007/0202796 | A1 * | 8/2007 | Kennedy et al. | 454/230 |
| 2008/0313969 | A1 | 12/2008 | Colucci et al. | |

FOREIGN PATENT DOCUMENTS

| | | | |
|---|---|---|---|
| GB | 515442 | A | 12/1939 |
| GB | 2043737 | A | 10/1980 |
| WO | WO 2005052319 | A1 * | 6/2005 |
| WO | WO 2005/086613 | A2 | 9/2005 |

* cited by examiner

REFUGE CHAMBER AND METHOD

CROSS-REFERENCE TO RELATED APPLICATIONS

This is a continuation application to U.S. patent application Ser. No. 11/903,079 filed Sep. 20, 2007 now abandoned, which claims priority from U.S. provisional patent application Ser. No. 60/846,432 filed Sep. 22, 2006.

FIELD OF THE INVENTION

The present invention is related to a refuge chamber that can easily be moved with a fork lift or front end loader. More specifically, the present invention is related to a refuge chamber that can easily be moved with a fork lift or front end loader having a skid and a tent that is disposed in the skid in an undeployed state which is expandable to a deployed state and extends from the skid to provide a protected atmosphere for the miners.

BACKGROUND OF THE INVENTION

Existing refuge chambers are typically a steel structure that is 6 foot high, 6 feet wide and can be from 14 to 20 feet in length, as shown in FIG. 1. This makes it difficult to move into a mine as well as move in a mine when they are deployed.

Typically, coal mines advance at 50 to 75 feet per day. Obviously, in tunnel boring and other types of mining they tend to advance away from the surface opening and fresh air sources. In order to ensure that the refuge chamber is located close to the mining areas, typically these refuge chambers need to be within 500-1000 feet of the working area. This means they have to be moved on a regular basis.

The refuge chamber of the present invention can be moved easily due to its smaller size and height. As the fresh Air Bay tent is inside the skid, it remains protected until it needs to be deployed.

The refuge chamber then can be used to provide breathable air in the event of an emergency as typically fans and ventilation structures can be damaged or are turned off to remove potential sparks and air from any fire.

Rooms are also built into the mines and act as refuge chambers. These have limited application and new rooms have to be built as the mines advance. The refuge chamber can simply be moved along with the mining equipment.

BRIEF SUMMARY OF THE INVENTION

The present invention pertains to a refuge chamber for miners in a mine. The chamber comprises a skid. The chamber comprises a tent that is disposed in the skid in an undeployed state which is expandable to a deployed state and extends from the skid to provide a protected atmosphere for the miners.

The present invention pertains to a method for providing a refuge chamber for miners in a mine. The method comprises the steps of opening a skid made of metal. There is the step of expanding a tent that is disposed in the skid in an undeployed state to a deployed state that extends from the skid to provide a protected atmosphere for the miners.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
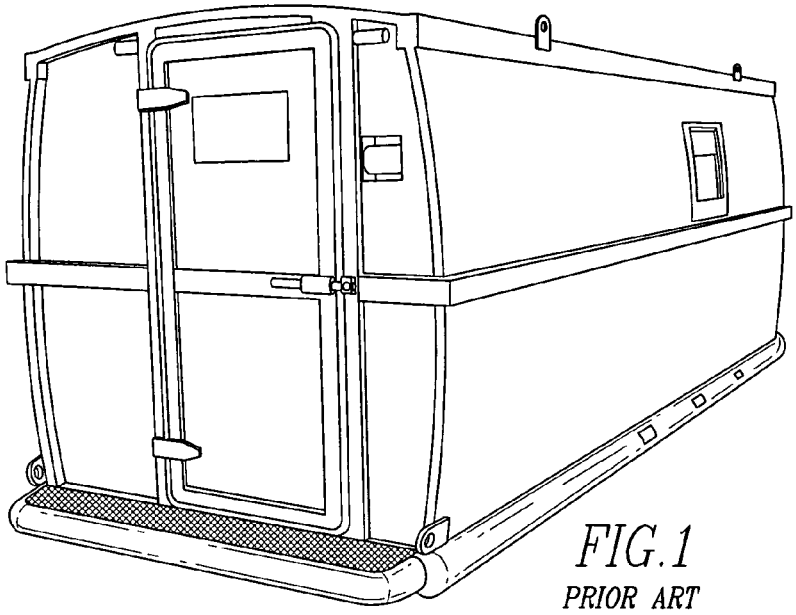
FIG.1 PRIOR ART
FIG. 1 shows a prior art refuge chamber.

Referring now to the drawings wherein like reference numerals refer to similar or identical parts throughout the several views, and more specifically to FIGS. 5-8 thereof, there is shown a refuge chamber 10 for miners in a mine. The chamber 10 comprises a skid 12. The chamber 10 comprises a tent 14 that is disposed in the skid 12 in an undeployed state which is expandable to a deployed state and extends from the skid 12 to provide a protected atmosphere for the miners.

Preferably, the skid 12 has a scrubber 16. The skid 12 preferably has a cooling system 18. Preferably, no external power is required to operate the scrubber 16 or cooling system 18. The skid 12 preferably has an inspection door 20.

Figure 4:
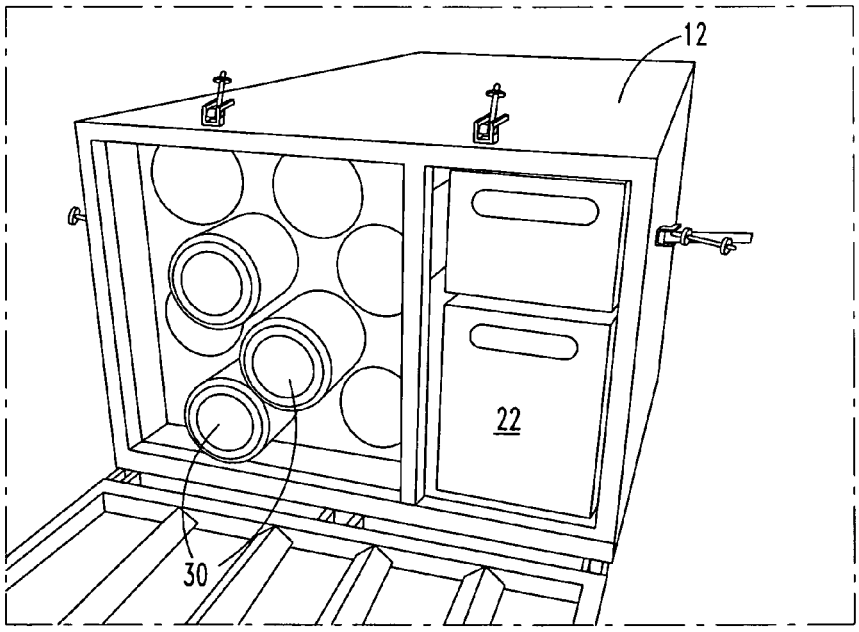
FIG. 4 shows a rear inspection door to access drawers and supplies.
Figure 5:
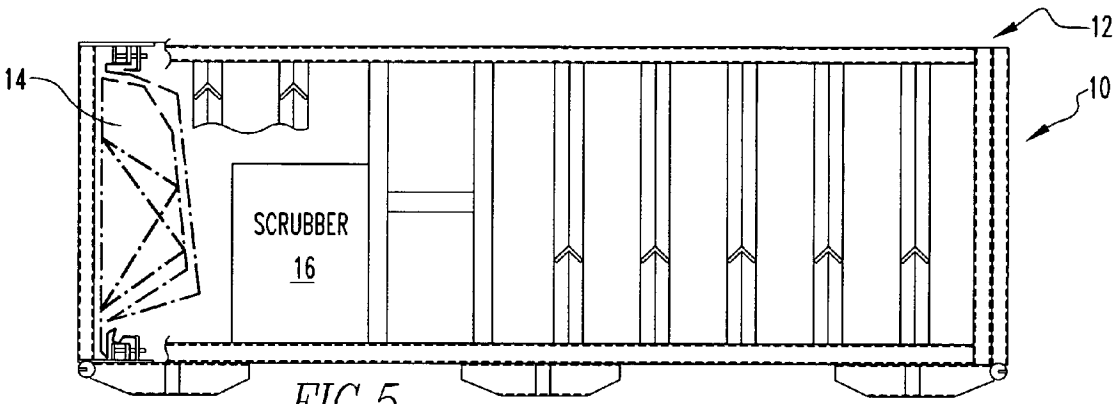
FIG. 5 shows the metal skid as it is transported and stored.
Figure 10:
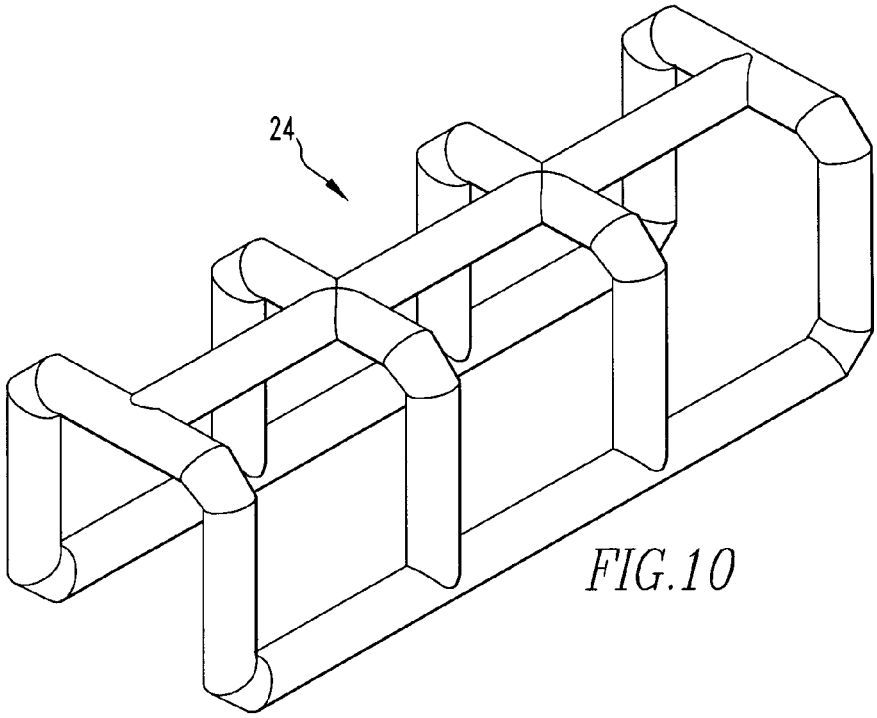
FIG. 10 shows the inflatable structure that is inside the tent.

Preferably, the skid 12 has a drawer system 22 that is accessed from the tent 14, as shown in FIGS. 4 and 5. The tent 14 preferably includes an expandable support structure 24, as shown in FIG. 10, and a seal 26 which seals the tent 14 to the skid 12 in a deployed state. Preferably, the tent 14 has an airlock 28. The support structure 24 is preferably expandable from an undeployed state to a deployed state. Preferably, the support structure 24 is inflatable.

The present invention pertains to a method for providing a refuge chamber 10 for miners in a mine. The method comprises the steps of opening a skid 12 made of metal. There is the step of expanding a tent 14 that is disposed in the skid 12 in an undeployed state to a deployed state that extends from the skid 12 to provide a protected atmosphere for the miners.

The skid 12 can be operated without any power or power connection—this means that if the power is disconnected, the structure can still be deployed and used. The fans in the scrubber 16 are run with compressed air and the breathable air is supplied via oxygen bottles 30 that are located in the skid 12. The cooling system 18 can also be powerless, as more fully described below.

By being made of metal and preferably steel, it can withstand explosions.

The compressed air is already connected to the scrubber 16 motor. All the miners need to do is turn on the smith/valve to activate the system. The skid 12 contains a bank of compressed air bottles 30—they are used to run the scrubber 16 motor as well as fill the tent 14 and purge the tent 14 and air lock if required. Medical grade oxygen is also in bottles 30—normally four of them to provide the breathable air (replaces the air consumed) that is metered into the skid 12/tent 14 using a ball valve medical flow meter that is set depending on the number of people in the tent 14. The rate is predetermined at 30 liters per person per hour. The instructions in the skid 12 tell the occupants how to set the flow rate.

Inspection door 20 provides easy inspection and allows supplies to be changed as necessary.

The skid 12 contains a drawer system 22 that allows all the supplies like soda lime (for the scrubbing), water, food, and first aid kit to be stored safely. This drawer system 22 has the unique feature that it can be accessed from the inside of the tent 14. It can also be accessed from the inspection door 20 for routine maintenance.

Cooling is normally required in a refuge chamber 10 due the heat generated by the occupants, the scrubbing operation and in some cases by the temperature underground. Normally, an air conditioner is fitted into a refuge chamber 10 to provide cooling. This requires an electrical connection or a battery backup system. These can be unsafe in a coal mine due to potentially explosive gases and typically require special approvals and safety features. Presently, no air conditioners are approved for use in this environment. Two alternative cooling systems 18 are described herein.

The first system used a refrigeration system in the skid 12 that is loaded with chemical ice pack. These stored ice blocks can then be used to cool the chamber 10 in the event of an emergency. The power will be disconnected; however, the refrigeration unit stores and keeps the frozen pack until they are needed.

Another alternative is a chemical cooling pack that is stored in the skid 12 and used as required.—this has no power connection.

The cooling requirements have been calculated based on the mine temperature, occupancy rate and the expected time of the tent 14 occupancy and can match the requirement to the amount of cool storage/chemical cooling systems 18 required.

Another unique feature of the skid 12 is that it is tight and so the tent 14 and the skid 12 become an integral unit when the tent 14 is opened. The tent 14 is connected via a bellows construction and gasket arrangement and is fixed to the skid 12.

The system has two distinct types of tent 14 attachments.

The first type is a tent 14 that is erected using compressed air that is used to blow up structural elements. The tent 14 is attached to these elements and erects on its own.

The other tent 14 is a manually erectable tent 14 that is self supporting and is drawn out of the skid 12 manually. It is designed with a structure that is self supporting and required no erection, apart from being pulled out from the skid 12. It expands in an accordion fashion from its undeployed state and is formed from plastic or metal strips connected together similar to an expandable gate. One of the further advantages of these tents 14 is that they can be made of any mine height—and that can be as low as 30 inches high. Occupants would crawl into the tent 14 in the case of a low mine height and then activate the controls in the skid 12 in the normal fashion.

The tent 14 has an air lock compartment so that the tent 14 can be entered without contamination of the entire fresh air bay. At the entrance to the tent 14, there is a small area with an inner flap that is zippered to the external wall which defines the air lock. A purge valve 32 connected to the compressed air valve allows the air in the air lock compartment to be purged. When the air lock has been purged and replaced with air from the compressed air bottle, the zipper can be opened to allow access to the main part of the tent 14. Tubing 34 extends from the skid 12 to which bottles 30 are connected to the air lock.

Another feature and advantage of the tent 14 is that the one way valves 36 are located on the top of the tent 14 so that the hottest air is escaping from the tent 14 helping to moderate the temperature. As air is constantly being released from the oxygen cylinders, it is necessary to have air relief valves to stop an over pressurization of the tent 14 structure.

Figure 2:
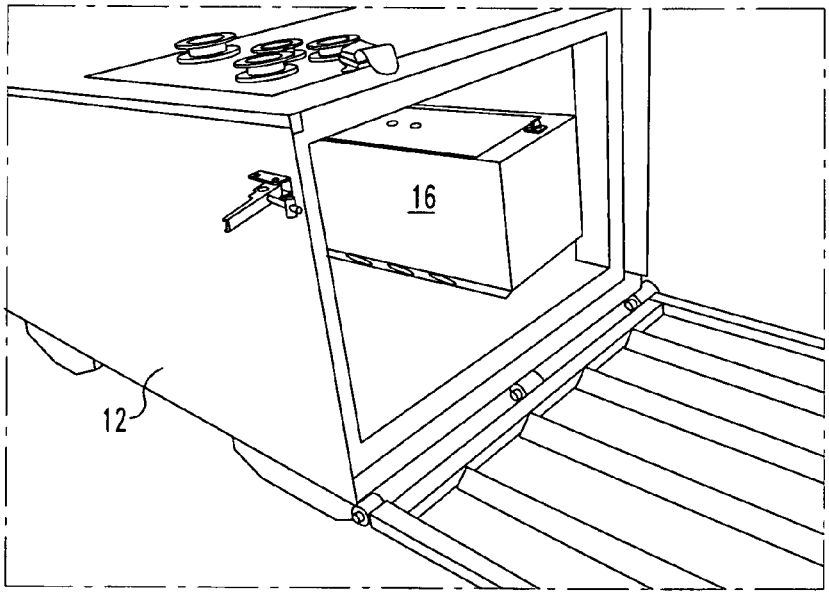
FIG. 2 shows the skid during construction showing the front door and scrubber positioned in the skid of the refuge chamber of the present invention.

FIG. 2 shows the skid 12 during construction showing the front door and scrubber 16 positioned in the skid 12. The scrubber 16 is fitted with an air motor. The tent 14 is attached to this side with a sealed diaphragm. The inside of the skid 12 can be accessed from the inside of the tent 14.

Figure 3:
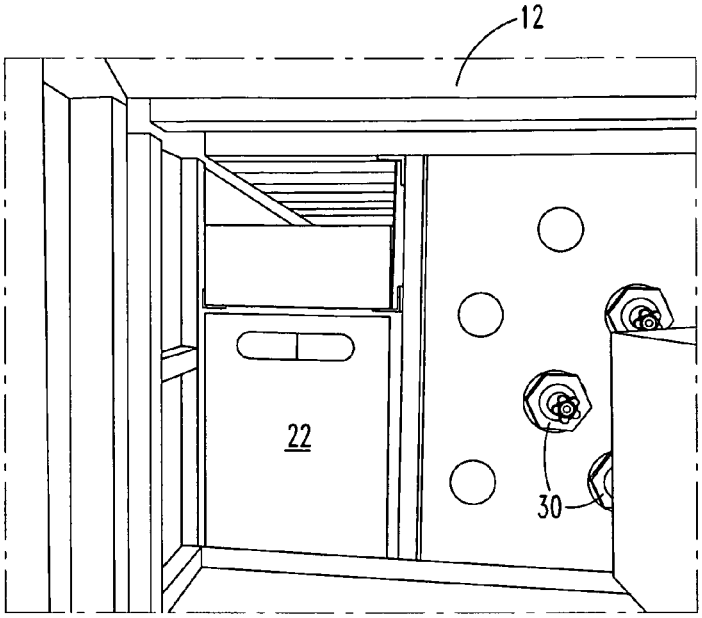
FIG. 3 is an internal view of the skid showing drawers and the front of the compressed air and oxygen bottles.

FIG. 3 is an internal view of the skid 12 showing drawers with all provisions and the front of the compressed air and oxygen bottles 30. FIG. 4 shows a rear inspection door 20 to access drawers and supplies.

Diagrammatically, the unit would work as follows:

FIG. 5 shows the metal skid 12 as it is transported and stored.

Figure 6:
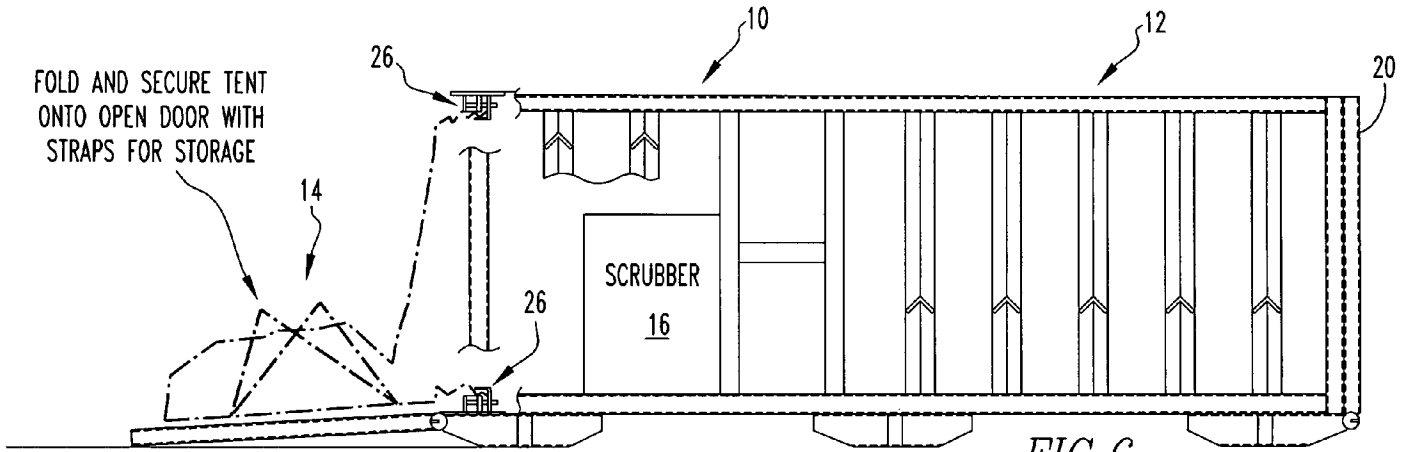
FIG. 6 shows the door of the skid being opened and the position of the tent prior to being inflated or erected.

FIG. 6 shows the door of the skid 12 being opened and the position of the tent 14 prior to being inflated or erected.

Figure 7:
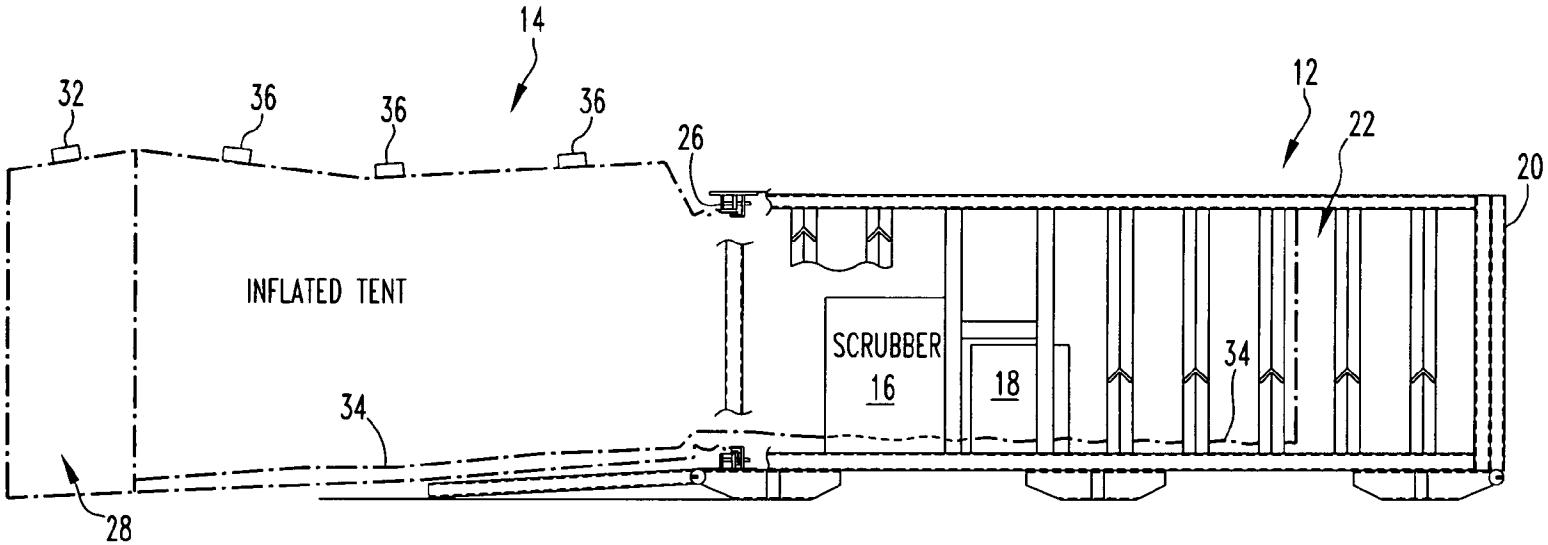
FIG. 7 shows the tent being deployed.

FIG. 7 shows the tent 14 being deployed.

Figure 8:
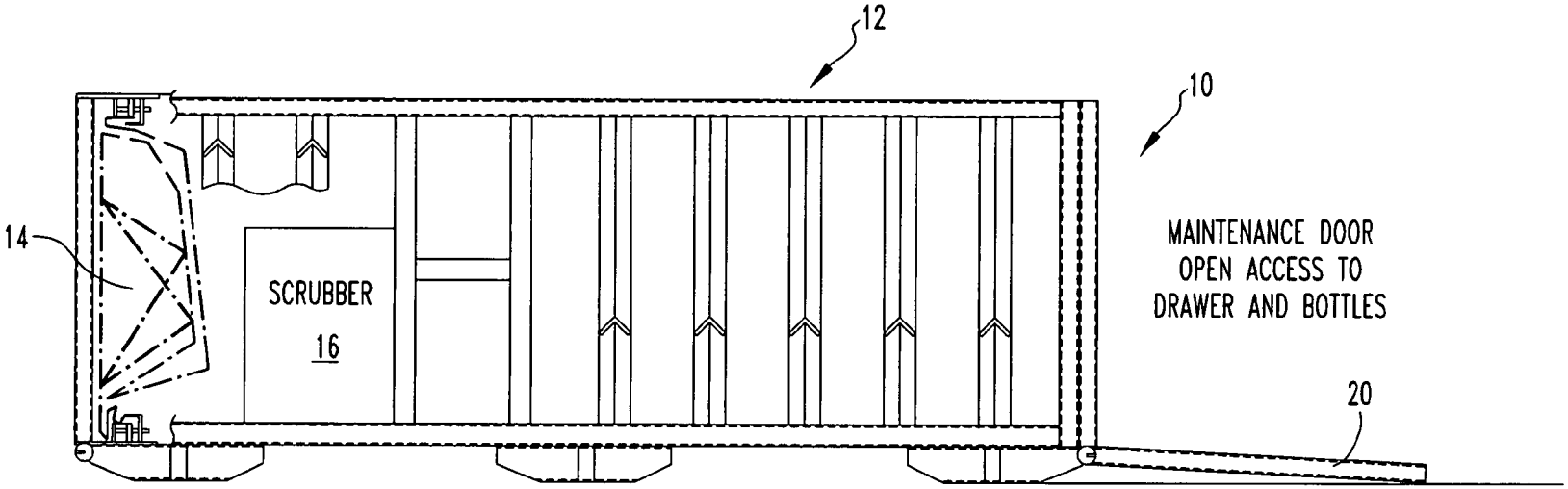
FIG. 8 shows the rear inspection door of the skid.

FIG. 8 shows the rear inspection door 20 of the skid 12.

Figure 9:
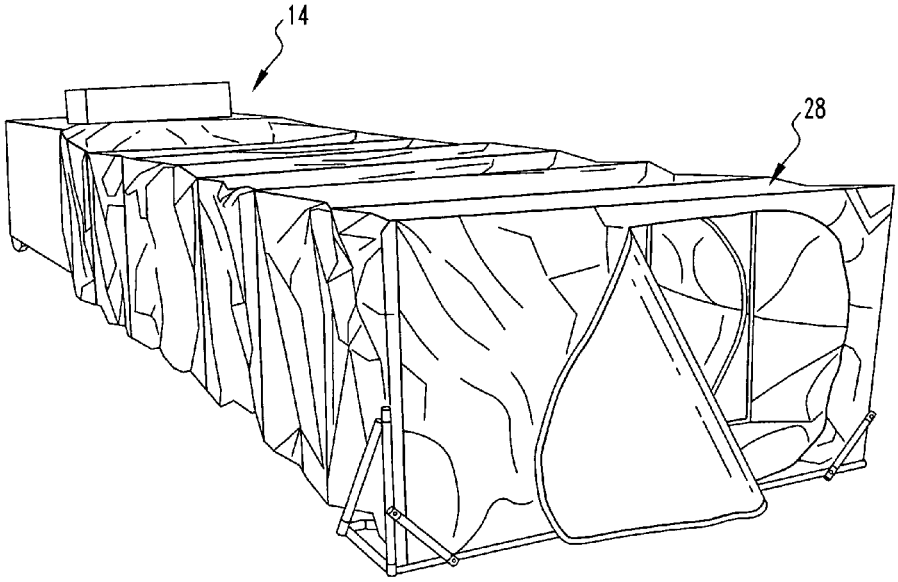
FIG. 9 shows the self-supporting tent attached to the skid.

FIG. 9 shows the self-supporting tent 14 attached to a skid 12. The air lock is in front.

FIG. 10 shows the inflatable structure that is inside the tent 14.

Figure 11:
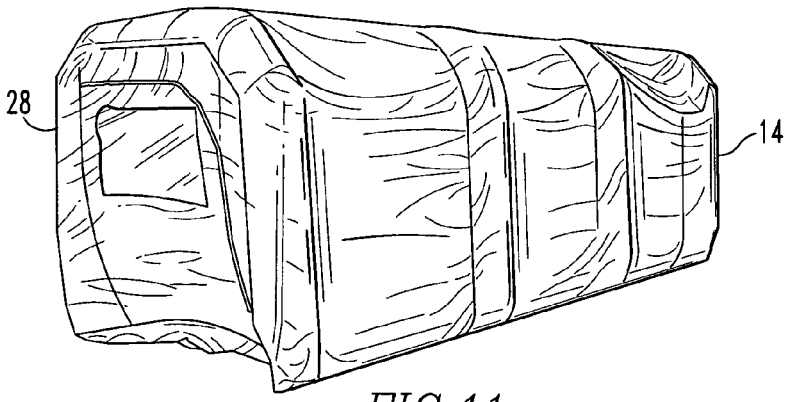
FIG. 11 shows the tent.

FIG. 11 shows the tent 14.

Figure 12:
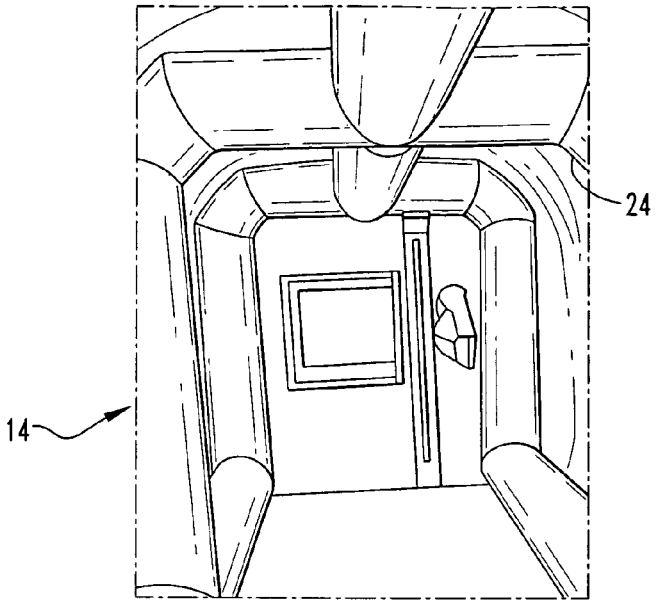
FIG. 12 shows the inside of the tent.

FIG. 12 shows the inside of the tent 14.

The refuge chamber 10 has a steel skid 12 mounted box that contains all items required to allow trapped miners to survive in irrespirable air for a period of time of at least four days or longer if equipped for that purpose.

The steel box is explosion proof (up to 15PSI) can be moved and placed in a suitable area in the mine.

The steel box contains the following unique features:

- Drawer systems 22 to hold supplies
  - Water
  - Food
  - Spare lights
  - Batteries
  - Air monitoring devices
  - First Aid kit
  - Other necessary supplies
- Scrubber 16 that can be air powered or battery operated to scrub CO2
- Oxygen and Compressed air bottles 30
- Control systems to manage and control the flow of oxygen and compressed air
- Tent 14 system can be:
  - Inflatable with compressed air
  - Or manually erectable The steel box has an inspection door 20 so that items in the box can be changed out periodically or inspected without deploying the tent 14.

The steel box has a door that opens out and allows the tent 14 to be erected.

The steel box is air tight.

The interior of the tent 14 is linked and the inside of the box can be accessed from the tent 14.

The size of the steel box is approximately 10 feet long 50 inches wide and 36 inches tall and allows for easy movement inside the mine and into the mine.

The unique features consist of the following features:

The entire concept of having a portable life support system.

The fact that all items are sized to fit into the steel box making the system totally portable.

The steel box linked into the tent 14 and having all the controls and equipment in the box.

The explosion proof design of the box.

The manually self standing/supporting tent 14.

The fact that the whole system can be operated without any external power source.

Figure 13:
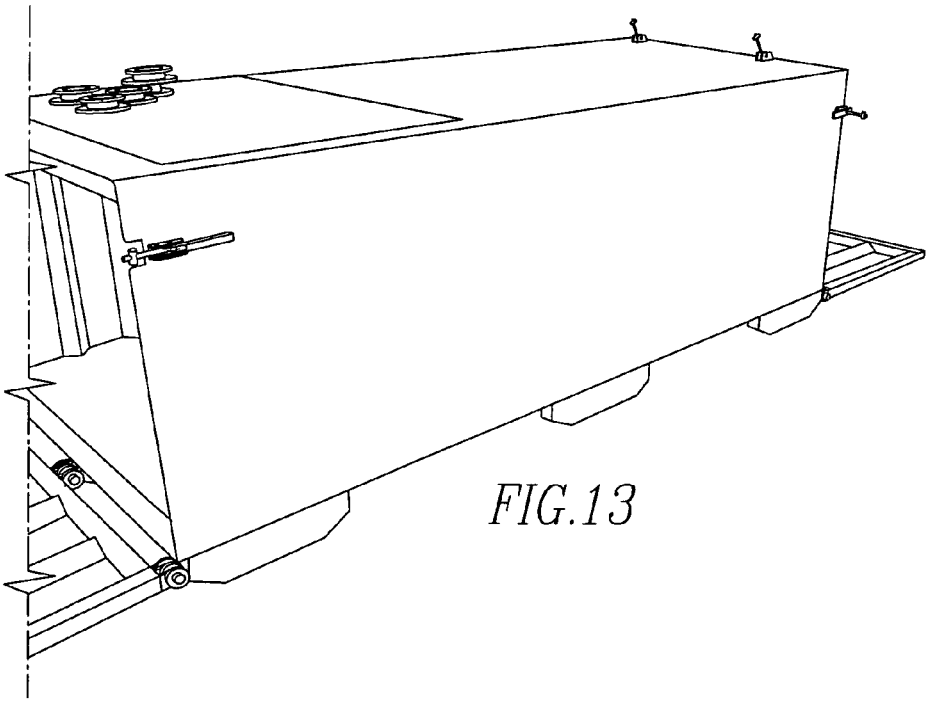
FIG. 13 is a perspective view of the skid.
Figure 14:
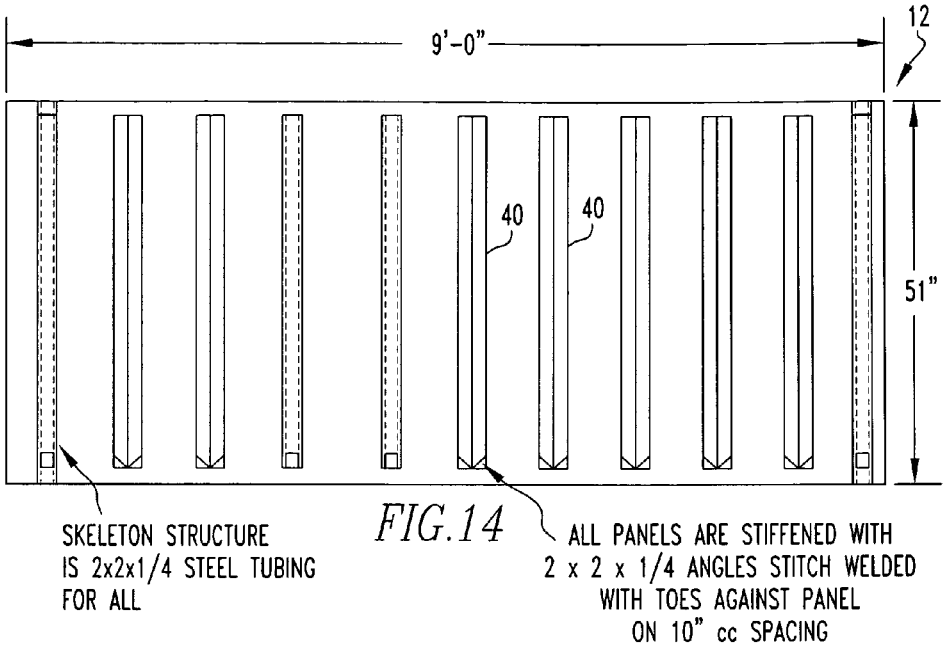
FIG. 14 is a view of the top of the skid.

FIG. 13 is a perspective view of the constructed skid made of metal. FIG. 14 is a view of the top of the skid. In the panels that make up the walls of the skid are angles 40 that are stitch welded with toes against the panel.

Figure 15:
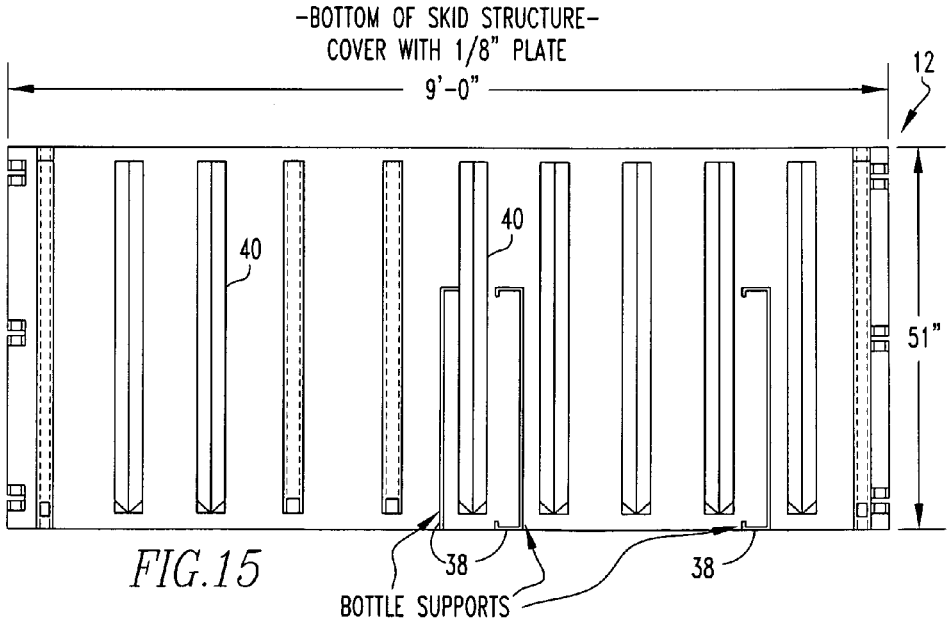
FIG. 15 is a view of the bottom of the skid.

FIG. 15 is a view of the bottom of the skid. The bottle support 38 is positioned in the bottom of the skid.

Figure 16:
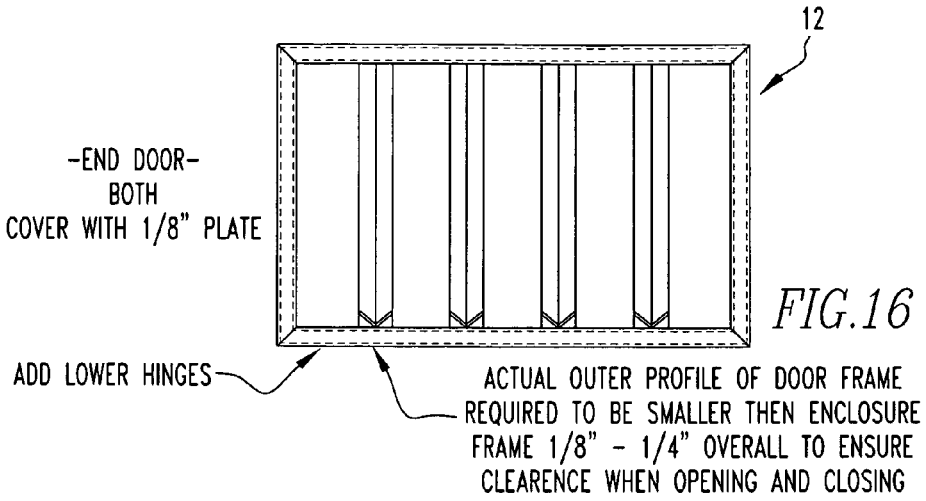
FIG. 16 shows the end door found on both sides of the skid.

FIG. 16 shows the end door found on both sides of the skid.

Figure 17:
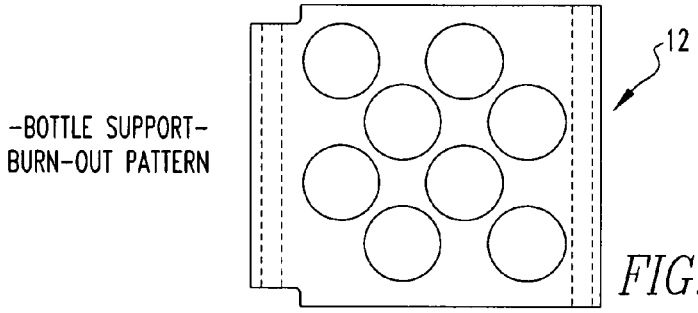
FIGS. 17 and 17*a* show the bottle support.
Figure 17A:
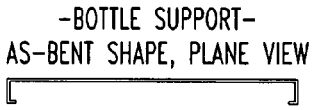

FIGS. 17 and 17*a* show the bottle support 38.

Figure 18:
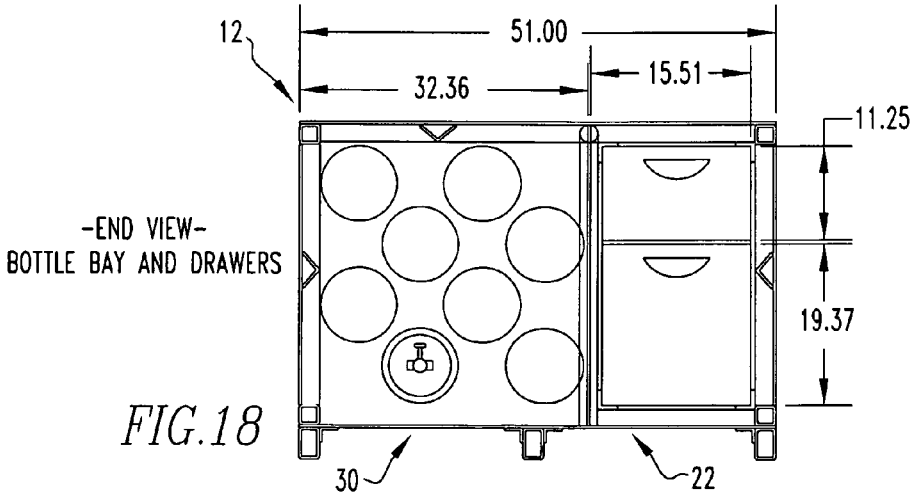
FIG. 18 shows a view of the bottle bay and drawers.

FIG. 18 shows a view of the bottle bay and drawers.

Figure 19A:
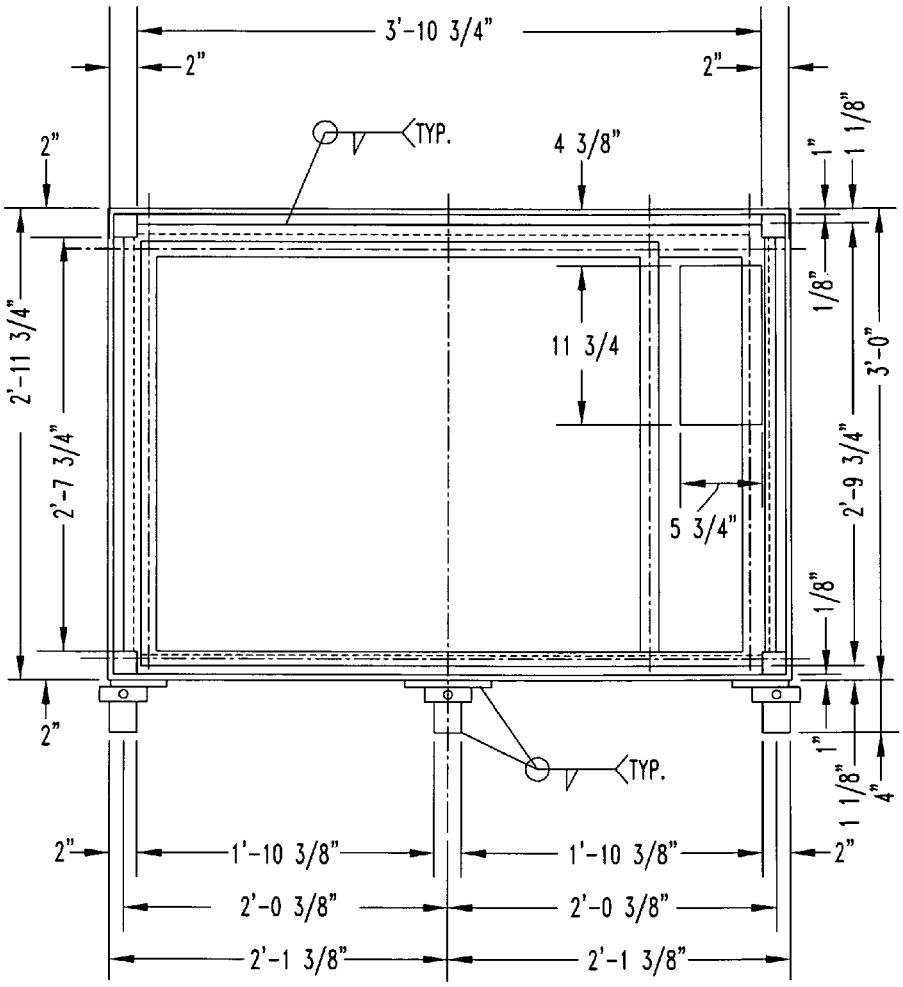
FIG. 19*a* is an end view of a preferred embodiment of the skid.
Figure 19B:
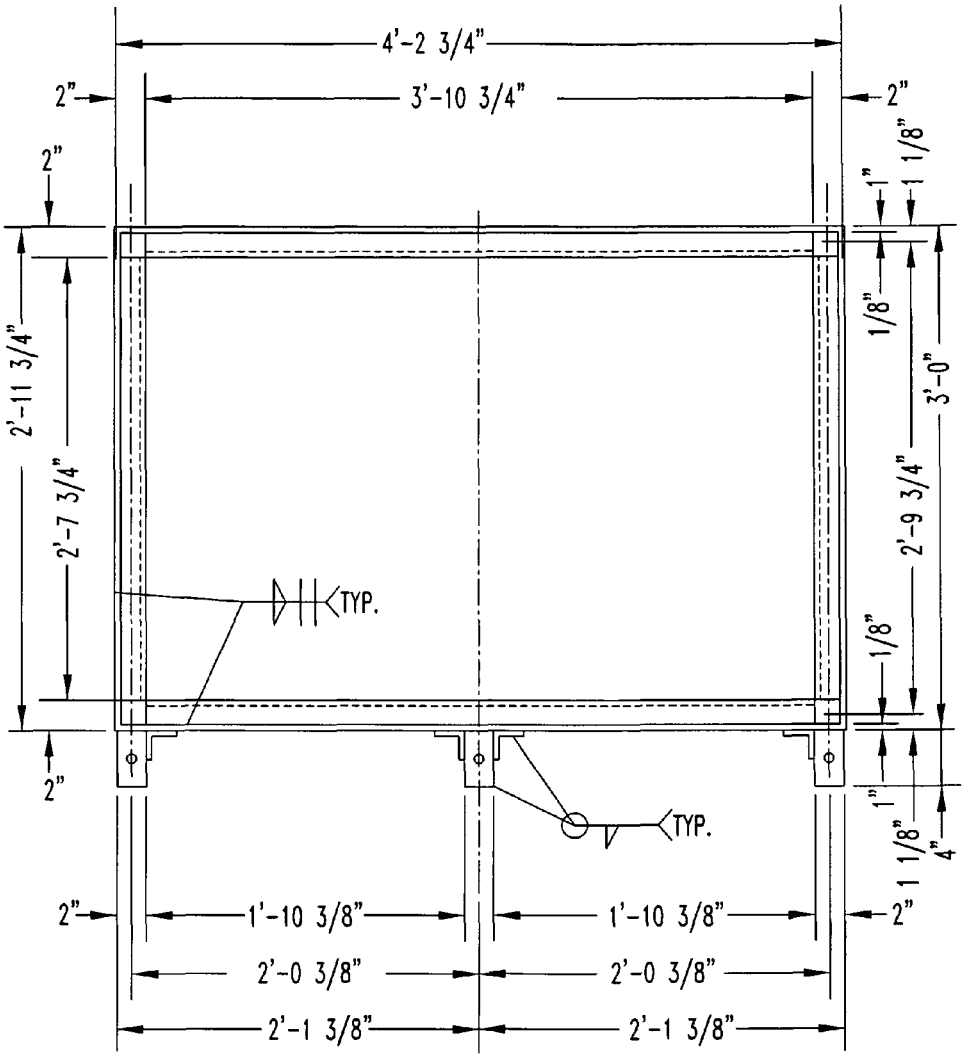
FIG. 19*b* is an end view of a preferred embodiment of the skid.
Figure 19C:
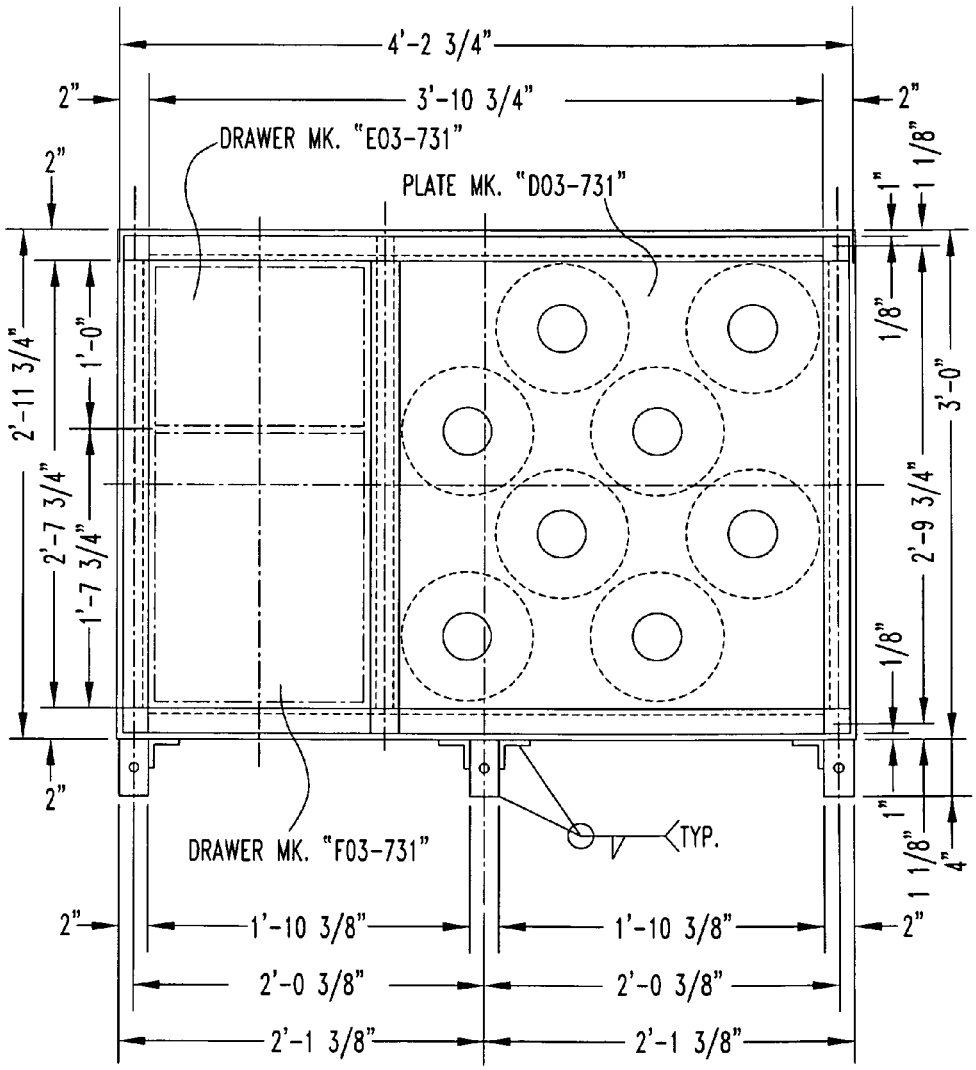
FIG. 19*c* is an internal view of the drawer system and the bottles.
Figure 19D:
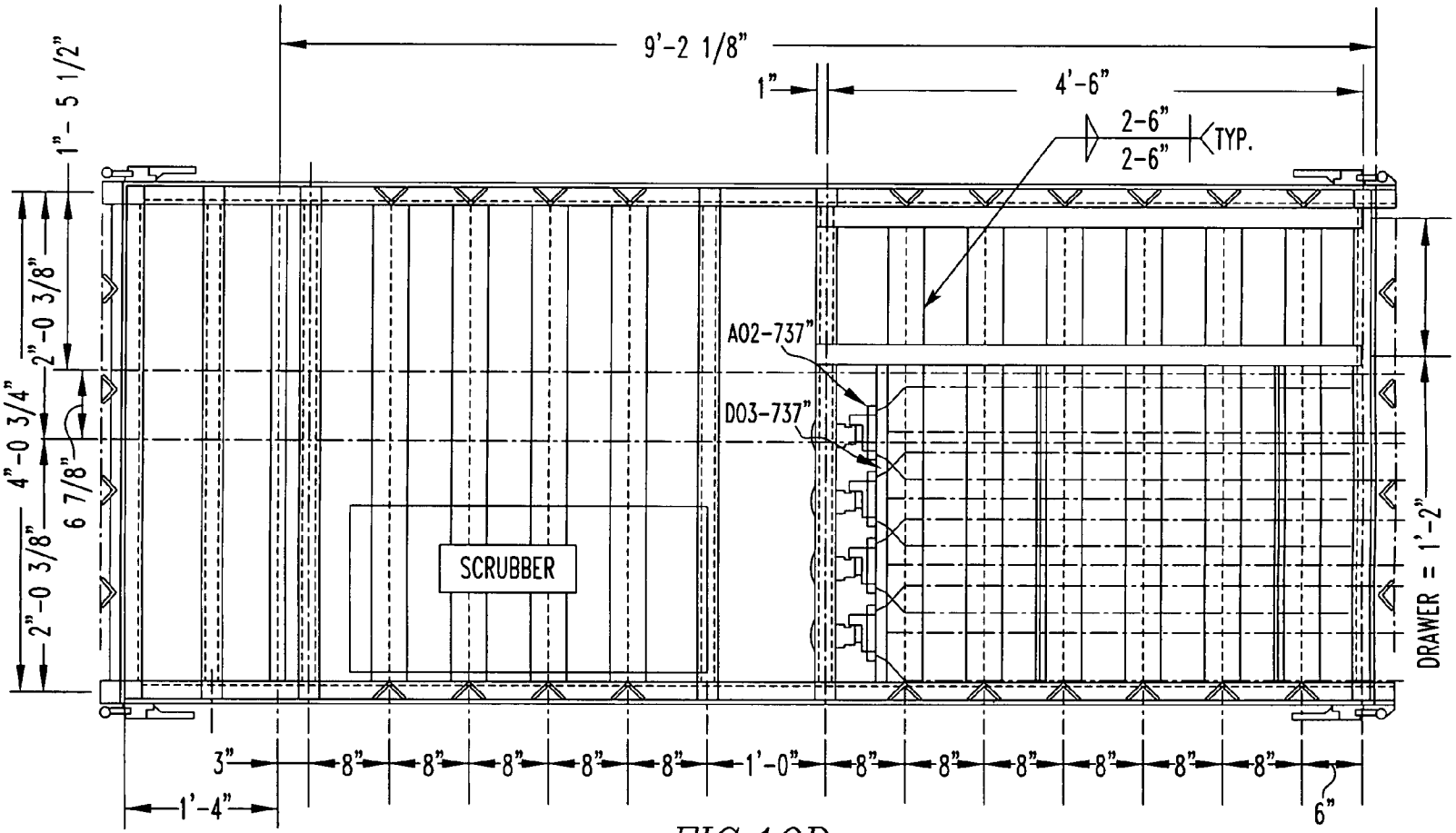
FIG. 19*d* is a side view of the skid with the doors closed.
Figure 19E:
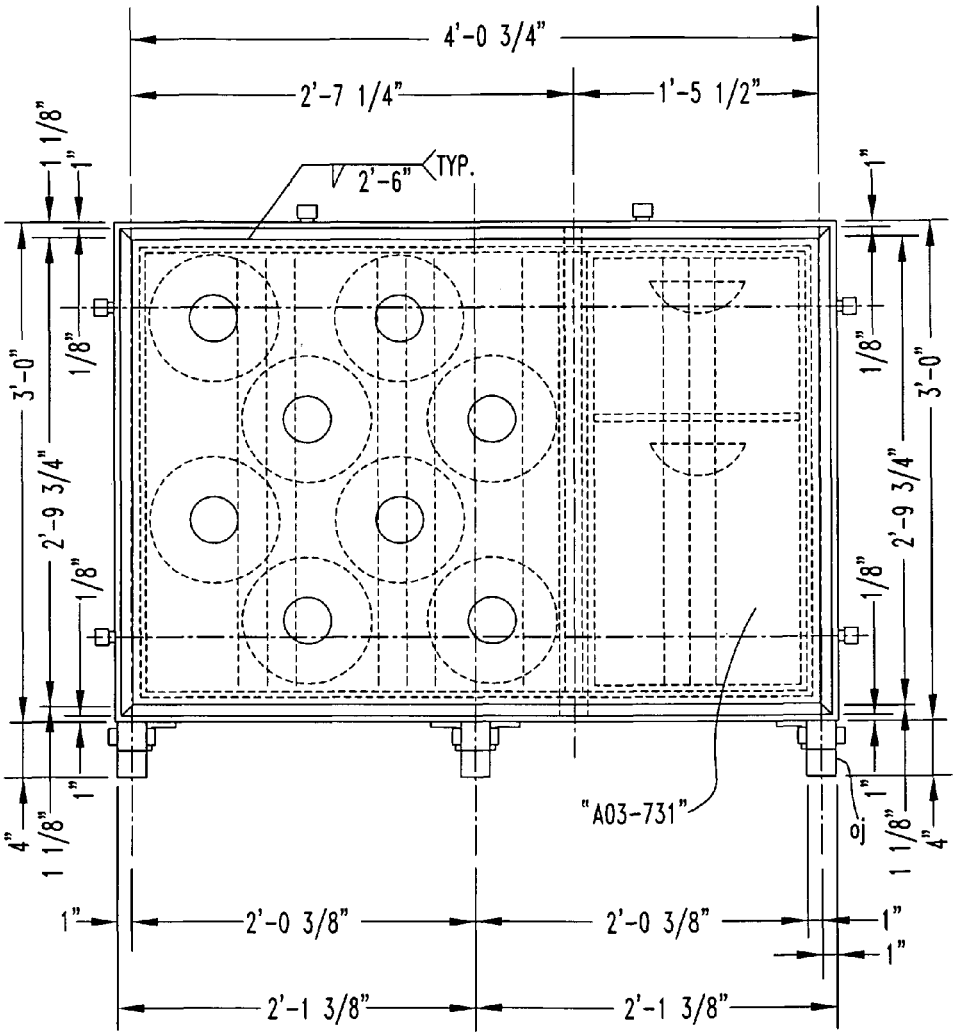
FIG. 19*e* is an end view of the drawer system and the bottles.
Figure 19F:
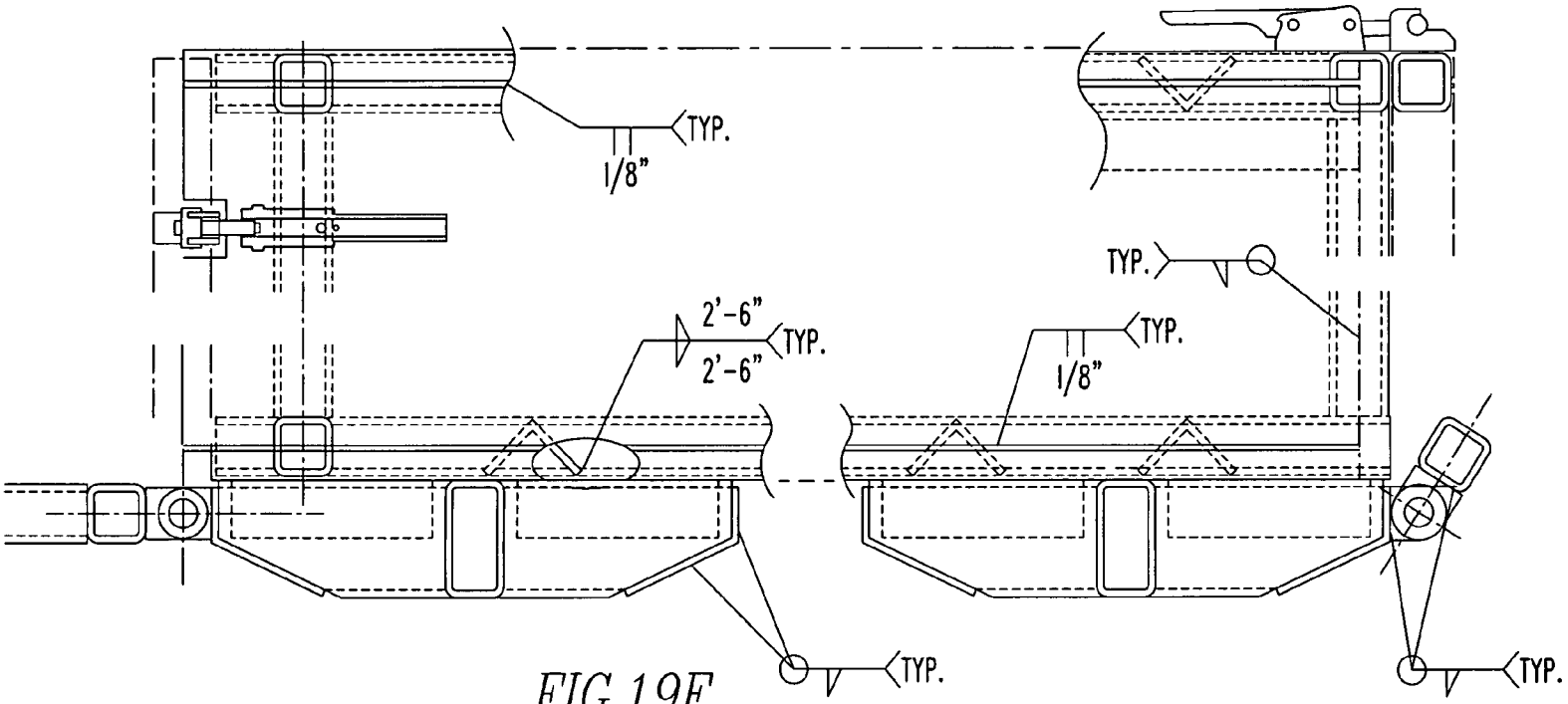
FIG. 19*f* is a side view of the portions of the end of the skid with the hinges.
Figures 1, 19G:
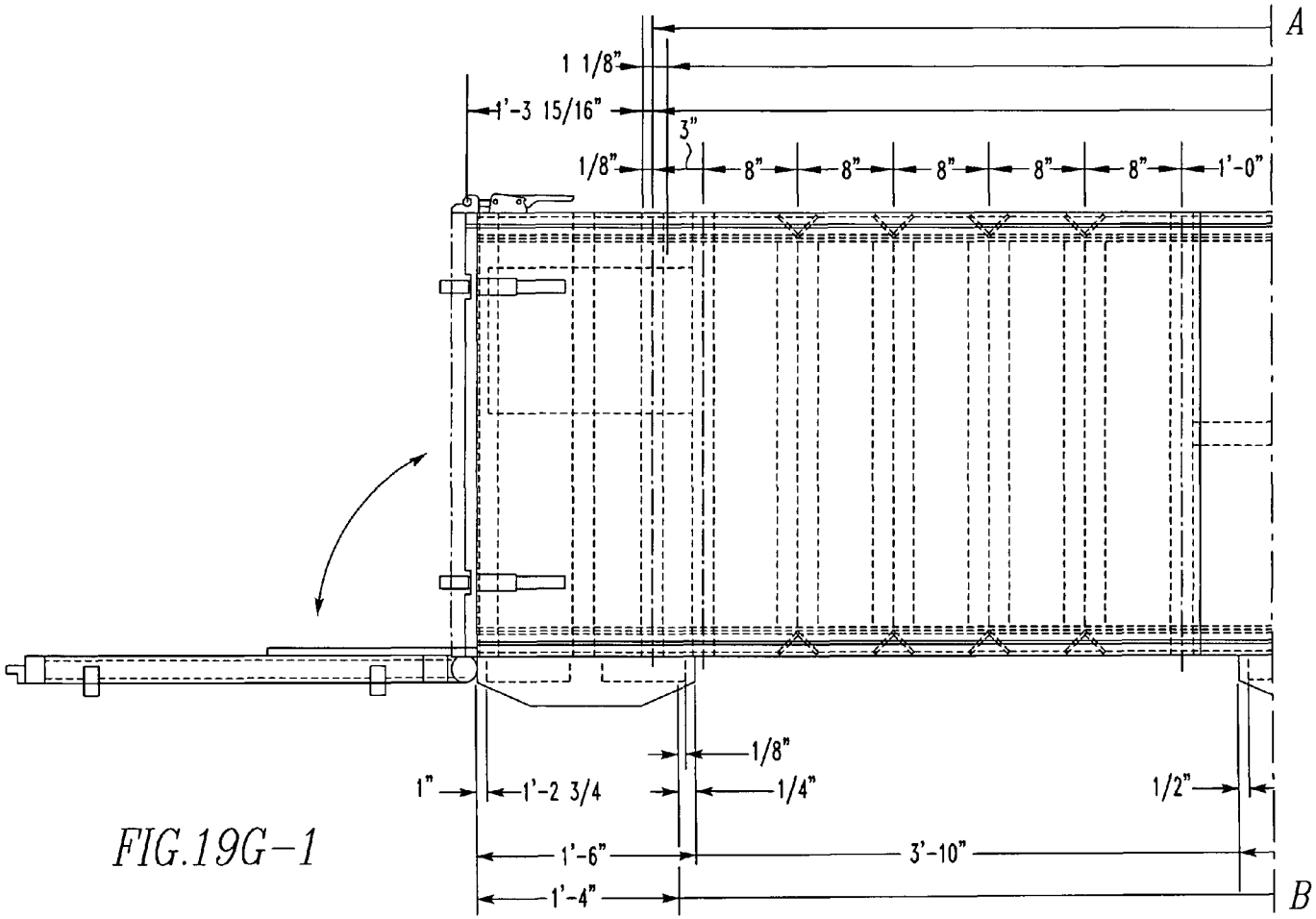
FIG. 19*g* is a side view of the skid with the doors open.
Figures 2, 19G:
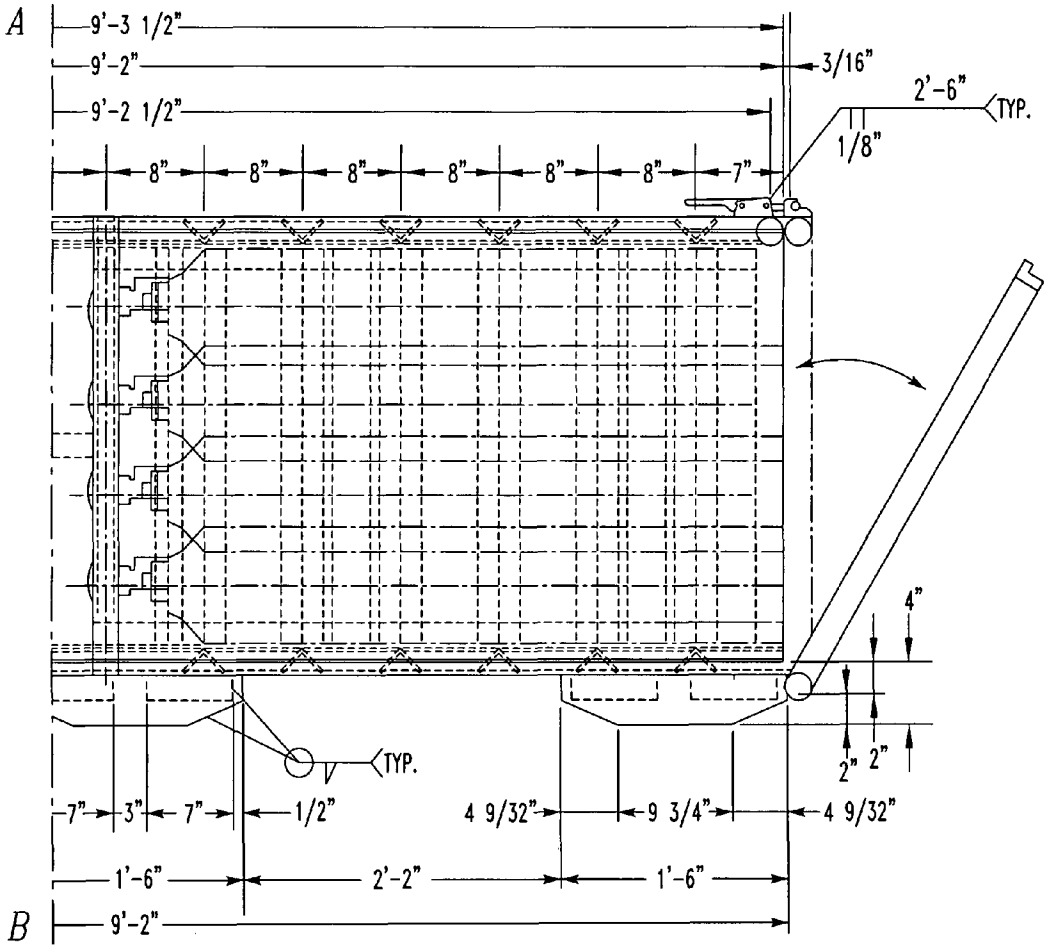

FIG. 19*a* is an end view of a preferred embodiment of the skid. FIG. 19*b* is an end view of a preferred embodiment of the skid. FIG. 19*c* is an internal view of the drawer system and the bottles 30. FIG. 19*d* is a side view of the skid with the doors closed. FIG. 19*e* is an end view of the drawer system and the bottles 30. FIG. 19*f* is a side view of the portions of the end of the skid with the hinges. FIG. 19*g* is a side view of the skid with the doors open.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A refuge chamber for miners in a mine, comprising:

a) a rigid container;

b) a tent having an inflatable support structure, wherein the tent is disposed within the container in an undeployed state and is expandable to a deployed state in which the tent extends from the container, wherein the tent is sealed to the container and is configured to form an integral unit with the container which is capable, in the deployed state, of providing a protected atmosphere for the miners therewithin;

c) supplies, wherein the supplies are disposed within the container, and wherein the supplies are accessible from inside the tent in its deployed state; and d) compressed air bottles, wherein the tent is configured to expand from the undeployed state to the deployed state upon inflation of the tent support structure by compressed air from said bottles; and wherein the tent has an airlock that is configured to allow access, in the tent's deployed state, from the mine into the protected atmosphere within the deployed tent.

2. The chamber as described in claim 1 wherein the airlock includes a purge valve.

3. The chamber as described in claim 2, further comprising tubing connecting at least one of the compressed air bottles to the airlock.

4. The chamber as described in claim 3, further comprising one way valves connected to the tent.

5. The chamber as described in claim 4, wherein the tent includes a seal which seals the tent to the container when the tent is in the deployed state.

6. The chamber as described in claim 5, wherein the container is explosion proof.

7. The chamber as described in claim 6, wherein the container has an inspection door that permits access to the compressed air bottles in the undeployed state.

8. The chamber as described in claim 7, wherein the container has a drawer system that is accessible from within the tent in its deployed state.

9. The chamber as described in claim 8 wherein the container is approximately 10 feet long, 50 inches wide and 36 inches tall.

10. A method for providing a refuge chamber for miners in a mine comprising the steps of:

positioning a refuge chamber according to claim 1 at a desired location in a mine.

11. A refuge chamber for miners in a mine, comprising:

a) an explosion-proof container up to 15 PSI;

b) a tent having an inflatable support structure, wherein the tent is disposed within the container in an undeployed state and is expandable to a deployed state in which the tent extends from the container, wherein the tent is sealed to the container, and is configured to form an integral unit with the container which is capable, in the deployed state, of providing a protected atmosphere for the miners therewithin, the container with the tent in the undeployed state is portable;

c) supplies, wherein the supplies are disposed within the container, and wherein the supplies are accessible from inside the tent in its deployed state; and d) compressed air bottles, wherein the tent is configured to expand from the undeployed state to the deployed state upon inflation of the tent support structure by compressed air from said bottles.

12. The refuge chamber of claim 11, further including an entrance that is configured to allow entry, after the tent is inflated, from outside the refuge chamber into the tent's interior.

13. The chamber as described in claim 12, wherein the entrance includes an airlock.

14. The chamber as described in claim 13 wherein the airlock includes a purge valve.

15. The chamber as described in claim 14, further comprising tubing connecting at least one of the compressed air bottles to the airlock.

16. The chamber as described in claim 15, further comprising one way valves connected to the tent.

17. The chamber as described in claim 16, wherein the tent includes a seal which seals the tent to the container when the tent is in the undeployed and in the deployed state.

* * * * *